United States Patent [19]

Pleschiutschnigg et al.

[11] Patent Number: 4,884,624

[45] Date of Patent: Dec. 5, 1989

[54] PROCESS ON A CONTINUOUS CASTING MACHINE TO PRODUCE STRANDS

[75] Inventors: Fritz-Peter Pleschiutschnigg, Duisburg; Joachim Von Schnakenburg, Kempen; Lothar Parschat, Ratingen; Peter Stadler, Siegen, all of Fed. Rep. of Germany

[73] Assignee: Mannesmann Aktiengesellschaft, Dusseldorf, Fed. Rep. of Germany

[21] Appl. No.: 315,886

[22] Filed: Feb. 24, 1989

[30] Foreign Application Priority Data

Feb. 26, 1988 [DE] Fed. Rep. of Germany ..... 3806583

[51] Int. Cl.[4] ..... B22D 11/20

[52] U.S. Cl. ..... 164/454; 164/413

[58] Field of Search ..... 164/454, 413, 490, 440

[56] References Cited

U.S. PATENT DOCUMENTS

| | | | |
|---|---|---|---|
| 3,358,743 | 12/1967 | Adams | 164/154 |
| 3,478,808 | 11/1969 | Adams | 164/154 |
| 4,341,259 | 7/1981 | Lavener | 164/413 X |
| 4,651,803 | 3/1987 | Tsuru et al. | 164/454 |

FOREIGN PATENT DOCUMENTS

| | | | |
|---|---|---|---|
| 57-97857 | 6/1982 | Japan | 164/413 |
| 784974 | 12/1980 | U.S.S.R. | 164/413 |
| 784975 | 12/1980 | U.S.S.R. | 164/413 |
| 900952 | 1/1982 | U.S.S.R. | 164/413 |
| 904880 | 2/1982 | U.S.S.R. | 164/413 |
| 1039642 | 9/1983 | U.S.S.R. | 164/454 |

*Primary Examiner*—Richard K. Seidel
*Assistant Examiner*—J. Reed Batten, Jr.
*Attorney, Agent, or Firm*—Nils H. Ljungman

[57] ABSTRACT

Molten metal is introduced into a tubular mold and is withdrawn from the mold in the partly solidified state. There is included a sensor to measure the behavior of the metal strand as close as possible to the mold in order to control or regulate the drive unit for the withdrawal of the strand on a continuous casting machine. For a more precise determination of the actual conditions, the movement of the strand is measured in an area close as possible to the point where the strand leaves the mold. The measurement of the movement may be made in a non-contact and non-delayed manner by the sensor which responds to radiation. The sensor is designed and positioned so that it produces an evaluatable measurement signal in response to the displacement-time behavior of the strand. The measurement signal is transmitted to a display unit and/or evaluation unit for adjustment of the drive unit in order to obtain the desired speed of withdrawal.

16 Claims, 1 Drawing Sheet

PROCESS ON A CONTINUOUS CASTING MACHINE TO PRODUCE STRANDS

BACKGROUND OF THE INVENTION

This invention relates to a process on a continuous casting machine for the production of strands, in particular of steel strands, in which molten metal is introduced into a tubular mold and is withdrawn from the mold in a partly solidified state. The invention also includes an apparatus for performing the process.

2. Description of the Prior Art

On continuous casting machines of the vertical or curved type, the withdrawal machine is regulated on the basis of a specified strand withdrawal velocity. The direction and speed of the withdrawal will normally remain constant during casting. To maintain the specified conditions and/or to determine anomalies in the guide section of the cast strand or in the mold, the prior art (U.S. Pat. Nos. 3,478,808 and 3,358,743) recommends measuring the current absorbed by the drive unit of the withdrawal machine, and using this value in a control circuit to control or regulate a continuous casting machine. With a constant withdrawal direction and an oscillating mold, this method is intended to yield information on the sliding action of the strand in the mold. The prior art cited above also indicates that other information on the strand produced can be obtained, for example, by measuring the surface temperature of the strand below the mold, by measuring across the thickness of the strand, or even by measuring the length of the strand produced. This information may also be included in the control circuit of the continuous caster.

On horizontal continuous casting machines with oscillating or fixed molds, the withdrawal direction does not necessarily remain constant even though the strand is continuously in motion The strand could be transported in steps with intervening stops or could be transported with a short reverse stroke and another stop.

Depending on the dimensions and withdrawal speed of the strand, there is a distance of several meters between the mold and the drive unit for the strand, since the drive unit is generally located in the vicinity of the completely solidified strand. Between the mold and the drive unit, such as in the vicinity of the solidification section, a portion of the strand is still molten but includes the thin steel shell which is relatively weak at the high temperatures. Moreover, it is known that a reproducible withdrawal rate of the strand is of decisive importance for the formation of the steel shell in the mold and for the achievement of an acceptable strand surface. Because of the mechanical instability or weakness of the partly-molten strand, the methods described above, however, cannot determine whether or not the withdrawal rate specified by the drive unit is transmitted by the strand to the segment of the strand in the mold and, if so, with what effect.

OBJECT OF THE INVENTION

It is an object of this invention to measure the behavior of a metal strand as close as possible to the production point.

It is another object to indicate a process and an apparatus which make it possible to control or regulate the drive unit for the withdrawal of a strand on a continuous casting machine.

It is yet another object to provide such a continuous casting machine which could, in particular, include a horizontal mold and discontinuous strand withdrawal, so that the actual conditions can be more precisely taken into consideration.

SUMMARY OF THE INVENTION

These and other objects of the invention are provided in a preferred process on a continuous casting machine to produce strands and, in particular, steel strands. In the process, molten metal is introduced into a tubular mold and withdrawn from the mold in a partly solidified state. According to the invention, the movement of the strand is preferably measured in a region as close as possible to the point where it leaves the mold. Such a measurement of the movement could take place in a non-contact and undelayed manner by means of sensors responding to radiation. The preferred sensors are designed and positioned so that they produce an evaluatable measurement signal on the displacement-time behavior of the strand. The measurement signal is transmitted to a display and/or evaluation unit.

In another embodiment of the invention, the signal characterizing the displacement-time behavior of the strand is compared, in the evaluation unit after appropriate processing, to a signal which corresponds to a control command for the drive unit withdrawing the strand from the mold. Variances between the measurement signal and the control signal of a control unit for the drive unit are fed forward. As a result, the movement transmitted by the drive unit to the strand will correspond to a specified displacement-time behavior of the strand at the measurement point. The measures proposed by the invention make it possible for the first time to measure the actual movement of the strand. Moreover, it is particularly important that the strand withdrawal can be controlled as a function of the desired movement of the strand. The measurement methods of the prior art, such as the measurement of the current absorbed by the drive unit or those obtained from a measurement roller with the well-known disadvantages, such as slip, wear, and overheating, have not met the requirements. Therefore steelmakers heretofore had to be content with approximate indications of the strand movement, without being able to consider or check on its actual behavior.

In another embodiment of the invention, the displacement-time behavior of the strand is measured at an additional measurement point between the mold and the drive unit. The two measurement points should be located at some distance from one another. The second measurement point can be appropriately located immediately ahead of the entry of the strand into the drive unit. Because of the simultaneous measurement of strand movement at two measurement points at some distance from one another, it is possible to obtain information on whether or not, under certain conditions, for example, as a function of the casting speed, format, temperature, grade or possibly as a result of characteristic vibrations of the strand, the measurement signal obtained at the exit from the mold is distorted. It is thus possible to operate a casting machine, possibly with an automatic regulation of the withdrawal system, outside a range of critical vibrations.

The invention also includes an apparatus for the performance of the preferred process described hereinabove on a continuous casting machine which comprises a casting vessel, a continuous casting mold and a drive unit for the withdrawal of the strand. On such an apparatus, there is preferably at least one diode line scan camera viewing the strand surface located downstream of the mold. The measurement signal from this diode line scan camera is transmitted to an evaluation unit. The control unit of the drive unit is also connected to the evaluation unit. As a result, the evaluation unit can simultaneously intervene to regulate the control unit of the drive unit. There is also a display unit and/or recording unit connected to the evaluation unit.

In summing up, one aspect of the invention resides in a process for continuously casting a strand from molten metal which is introduced into a tubular mold. The process comprises the steps of withdrawing the molten metal from the mold in a partially solidified state to form the strand by a drive unit; controlling the drive unit with a control signal; and measuring an actual movement of the strand at a location adjacent an exit of the mold. The measuring of the actual movement is used to obtain an actual measurement signal with non-contact sensor arrangement which responds to radiation of the strand without making contact therewith. The process also includes the steps of comparing the actual measurement signal with the control signal in an evaluation unit; providing to the evaluation unit desired information which corresponds to a desired movement of the strand at the location; and adjusting the control signal by the evaluation unit to adjust the withdrawing by the drive unit to cause the actual movement of the strand at the exit of the mold, as indicated by the actual measurement signal from the sensor arrangement, to approach the desired movement, as indicated by the desired information.

Another aspect of the invention resides broadly in an apparatus for controlling a continuous casting machine for producing strands from molten metal. The casting machine includes the molten metal being introduced into a tubular mold. A drive unit is employed for withdrawing the molten metal from the mold in a partially solidified state to form the strand. The apparatus includes an arrangement for controlling the drive unit. At least one diode line scan camera is located downstream of the mold to measure a surface of the strand. There is an evaluating unit for comparing the measuring by the scan camera and the arrangement for controlling the drive unit. The evaluating unit is capable of adjusting the arrangement for controlling the drive unit for causing the drive unit to produce a desired speed of the withdrawing of the strand as it passes by the scan camera.

Yet another aspect of the invention resides broadly in a process for continuously casting a strand from molten metal which is introduced into a tubular mold. The process includes the steps of withdrawing the molten metal from the mold in a partially solidified state to form the strand by a drive unit; controlling the drive unit with a control signal; and measuring an actual movement of the strand at a location adjacent an exit of the mold with noncontact sensor which responds to movement of the strand without making contact therewith. Additional steps include comparing the measuring of the actual movement with the withdrawing by the drive unit and adjusting the drive unit to change the withdrawing to cause the actual movement of the strand at the exit of the mold, as indicated by the measuring, to approach a desired movement of the strand at the exit location as would be indicated by the measuring by the sensor of the desired movement.

Still yet another aspect of the invention resides broadly in an apparatus for controlling a continuous casting machine for producing strands from molten metal. The casting machine includes the molten metal being introduced into a tubular mold and a drive unit for withdrawing the molten metal from the mold in a partially solidified state to form the strand. The apparatus includes an arrangement for controlling the drive unit and an arrangement for measuring an actual movement of the strand at a location adjacent an exit of the mold. The arrangement for measuring including a non-contact sensor for responding to movement of the strand without making contact therewith. An evaluation unit is for comparing a signal from the arrangement for controlling the drive unit with a signal from the arrangement for measuring. The evaluation unit can adjust the arrangement for controlling to cause the drive unit to change the actual movement for causing the actual movement to correspond to a desired movement of the strand at the location.

DESCRIPTION OF THE PREFERRED EMBODIMENT

Figure 1:
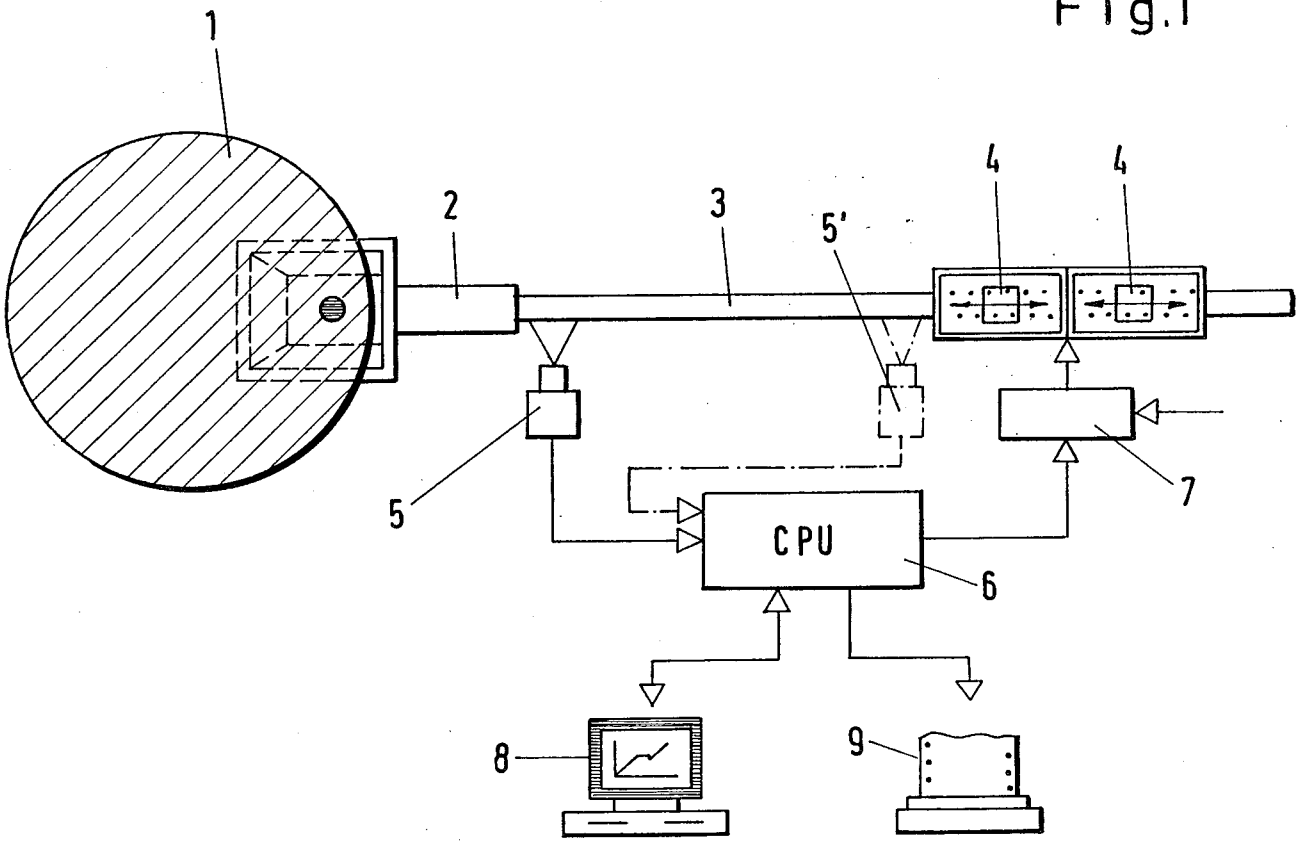
FIG. 1 is a schematic diagram of a preferred apparatus including various features of the invention.

As seen in the preferred schematic diagram of FIG. 1, downstream of a casting vessel 1, which can be a ladle or a tundish, is a mold 2 which is preferably tubular. The strand 3 is withdrawn from the mold 2 by means of a preferred drive unit 4. The molten metal from the vessel 1 is introduced into the tubular mold 2 and is withdrawn from the mold 2 in a partly solidified state by the action of the drive unit 4. The drive unit 4 is preferably designed to make possible a step-wise withdrawal of the strand. The drive unit 4 is controlled by a control unit 7.

In the preferred embodiment, the movement transmitted by the drive unit 4 to the strand 3 is viewed by a diode line scan camera 5, which is located immediately downstream of the mold 2. The movement of the strand 3 is preferably measured in a region as close as possible to the point where it leaves the mold 2. The diode line scan camera 5 or similar scanning device is positioned so that it can observe the surface of the strand after it leaves the mold 2. The principal characteristics of the surface are transmitted as measurement signals from the diode line scan camera 5 or similar scanning device to an evaluation unit 6. Such measurements of the movement take place in a non-contact and undelayed manner by means of the preferred sensors responding to radiation.

The preferred evaluation unit 6 cyclically and at a high frequency scans relevant image points and assigns them to a displacement-time diagram. This evaluation make possible an immediate determination of the actual movement, such as in the displacement-time behavior or movement of the strand 3 directly at the mold 2. The preferred evaluation unit 6 includes means for making a comparison between input signals indicating the actual movement of the strand 3, as determined by the observation of the surface near the mold 2, and the control signals from a control unit 7 for the drive unit 4. If the measurement signal from the diode line scan camera 5 or similar scanning device deviates from the control signals of the control unit 7, the evaluation unit 6 includes correction programming to make a correction of the control program so that the strand movement produced by the drive unit 4 coincides with the desired strand movement. Thereafter, the strand movement can be further checked by means of the diode line scan camera 5 or similar scanning device and confirmed or further corrected by the evaluation unit 6.

Those skilled in the strand forming art will recognize that characteristic vibrations are often produced in strands as they are being formed. Although all such vibrations are not harmful, there are some critical ranges of characteristic vibrations which are detrimental to the proper formation of the strands. In order to measure the characteristic vibrations of the strand, an additional diode line scan camera 5' or similar scanning device may be installed in the vicinity of the entrance of the strand into the drive unit 4. Accordingly, the displacement-time behavior of the strand 3 is measured at an additional measurement point between the mold 2 and the drive unit 4. The two measurement points, those of camera 5 and camera 5' should be located at some distance from one another. The second measurement point can be appropriately located immediately ahead of the entry of the strand 3 into the drive unit 4.

The measurement signals from the diode camera 5' or similar scanning device are also transmitted to the evaluation unit 6 which includes programmed means for evaluating the vibrations. It therefore becomes possible to take into consideration the characteristic vibrations of the strand or the casting machine and to adjust the operation of the overall casting machine so that the critical ranges can be avoided.

Because of the simultaneous measurement of strand movement at two measurement points at some distance from one another, it is possible to obtain information on whether or not, under certain conditions, for example, as a function of the casting speed, format, temperature, grade or possibly as a result of the characteristic vibrations of the strand, the measurement signal obtained at the exit from the mold 2 is distorted. It is thus possible to operate a casting machine, possibly with an automatic regulation of the withdrawal system, outside a range of critical vibrations. For example, critical vibrational ranges can be stored in a computer memory of the evaluation unit 6 or the like so that when these critical vibrational ranges are approached by the continuous casting apparatus, the evaluation unit will adjust the speed of the drive unit 4 to avoid the critical vibrational range.

In the preferred system of the present invention, the measurements of the various strand movements can be displayed on a display unit 8. The evaluation unit 6 can include display programming to convert the signals received therein into useful information which can then be shown on the display unit 8. Additionally, similar or alternative information can be provided to a recording unit 9 in order to keep a more permanent record for future evaluation and analysis of the strands 3 produced.

Although the preferred process and apparatus of the invention includes the numerous features described above, it should be clear to those skilled in the art that they are not all interdependent. In the simplest case, therefore, it would be possible to measure the actual movement of the strand 3 by means of the line scan camera 5, to analyze the information in the evaluation unit 6 and to display the results on the display unit 8. From this basic operation, the information could be advantageously used to simply check the movement of the strand 3 produced by the drive unit 4. Any adjustment or alteration of the drive unit 4 could then be made without the use of the more sophisticated and automatic controls described above for the preferred embodiment of the invention.

In summing up, one aspect of the invention resides broadly in a process on a continuous casting machine to produce strands, in particular steel strands, in which molten metal is introduced into a tubular mold and is withdrawn from the mold in the partly solidified state. The process is characterized by the fact that the movement of the strand is measured at a point as close as possible to the point where it leaves the mold, with no delay and in a contact-less manner. The movement of the strand is measured by sensors which respond to radiation. The sensors are designed and positioned so that they produce an evaluatable measurement signal on the displacement-time behavior of the strand. The signal characterizing the displacement-time behavior of the strand is compared in an evaluation unit to a signal which corresponds to a control command for the drive unit withdrawing the strand from the mold. Variances of the measurement signal from the control signal of a control unit of the drive unit are fed forward, so that the movement to be transmitted by the drive unit to the strand corresponds to a specified displacement-time behavior of the strand at the measurement point.

Another aspect of the invention resides broadly in a process characterized by the fact that the displacement-time behavior of the strand is simultaneously measured at another measurement point between the mold and the drive unit.

Yet another aspect of the invention resides broadly in an apparatus for the performance of the process on a continuous casting machine. The apparatus comprises a casting vessel, a continuous casting mold and a drive unit for the extraction of the strand. The apparatus is characterized by at least one diode line scan camera 5, 5' located downstream of the mold 2. The scan camera 5, 5' measures the surface of the strand 3 and is part of an evaluation unit 6 which is connected to the diode line scan camera 5, 5'. Also included is a control unit 7 of the drive unit 4, which is also connected to the evaluation unit 6, and a display unit 8 and/or recording unit 9, which are connected to the evaluation unit 6.

A number of patents are directed to and disclose various methods and apparatus for controlling continuous casting machines. Such patents include U.S. Pat. Nos. 3,861,456; 3,893,502: 3,923,091; 4,030,531; 4,073,332: 4,091,862: 4,497,360; 4,501,315; 4,703,789; and 4,714,106 which are incorporated herein by reference as if the entire contents thereof were fully set forth herein.

A number of patents are directed to and disclose various types of sensors or scanners including U.S. Pat. Nos. 4,778,770: 4,402,017; 4,755,880: 4,568,985: 4,532,544; and 4,475,130.

An example of a pattern recognition system is found in U.S. Pat. No. 4,612,666 entitled "Automatic Pattern Recognition Apparatus". All the patents cited herein are incorporated herein by reference as if the entire contents thereof were fully set forth herein.

The invention as described hereinabove in the context of a preferred embodiment is not to be taken as limited to all of the provided details thereof, since modifications and variations thereof may be made without departing from the spirit and scope of the invention.

What is claimed is:

1. A process for continuously casting a strand from molten metal which is introduced into a tubular mold, said process comprising the steps of:

withdrawing said molten metal from said mold in a partially solidified state to form said strand;

said withdrawing of said strand by a drive unit;

controlling said drive unit with a control signal;

measuring an actual movement of said strand at a location adjacent an exit of said mold;

said measuring of said actual movement to obtain a measurement signal with non-contact sensor means which responds to radiation of said strand without making contact therewith;

comparing said measurement signal with said control signal in an evaluation unit;

providing to said evaluation unit desired information which corresponds to a desired movement of said strand at said location; and adjusting said control signal by said evaluation unit to adjust said withdrawing by said drive unit to cause said actual movement of said strand at said exit of said mold, as indicated by said measurement signal from said sensor means, to approach said desired movement as indicated by said desired information.

2. The process according to claim 1, further including the step of measuring additional movement of said strand at an additional location between said location and said drive unit.

3. The process according to claim 2, wherein said measuring of said additional movement to obtain an additional measurement signal with an additional one of said sensors means, and further including the step of comparing said additional measurement signal and said measurement signal in said evaluation unit to determine vibrations of said strand.

4. The process according to claim 3, wherein said adjusting said control signal by said evaluation unit includes means for avoiding said vibrations which are in at least one undesired critical range.

5. Apparatus for controlling a continuous casting machine for producing strands from molten metal, said casting machine including said molten metal being introduced into a tubular mold, said casting machine including a drive unit for withdrawing said molten metal from said mold in a partially solidified state to form said strand, said apparatus comprising:

means for controlling said drive unit;

at least one diode line scan camera located downstream of said mold;

said scan camera measuring a surface of said strand;

means for evaluating including means for comparing a signal from said measuring by said scan camera and a signal from said means for controlling said drive unit; and said means for evaluating including means for adjusting said means for controlling said drive unit for causing said drive unit to produce a desired speed of said withdrawing of said strand as it passes by said scan camera.

6. The apparatus according to claim 5, wherein said means for evaluation includes at least one of a display means and a recording means.

7. A process for continuously casting a strand from molten metal which is introduced into a tubular mold, said process comprising the steps of:

withdrawing said molten metal from said mold in a partially solidified state by a drive unit to form said strand;

controlling said drive unit with a control signal;

measuring an actual movement of said strand at a location adjacent an exit of said mold with non-contact sensor means which responds to movement of said strand without making contact therewith;

comparing said measuring of said actual movement with said withdrawing by said drive unit; and adjusting said drive unit to change said withdrawing to cause said actual movement of said strand at said exit of said mold, as indicated by said measuring, to approach a desired movement of said strand at said exit location as would be indicated by said measuring by said sensor means of said desired movement.

8. The process according to claim 7, further including the step of measuring additional movement of said strand at an additional location between said location and said drive unit with an additional one of said sensors means.

9. The process according to claim 8, further including the step of comparing said measuring of said additional movement and said measuring of said actual movement to determine vibrations of said strand.

10. The process according to claim 9, further including the step of correcting said adjusting of said drive unit by reducing an effect of said vibrations.

11. The process according to claim 9, wherein said adjusting said drive unit includes avoiding said vibrations which are in at least one undesired critical range.

12. Apparatus for controlling a continuous casting machine for producing strands from molten metal, said casting machine including said molten metal being introduced into a tubular mold, said casting machine including a drive unit for withdrawing said molten metal from said mold in a partially solidified state to form said strand, said apparatus comprising:

means for controlling said drive unit;

means for measuring an actual movement of said strand at a location adjacent an exit of said mold;

said means for measuring including a non-contact sensor means for responding to movement of said strand without making contact therewith;

evaluation means for comparing a signal from said means for controlling said drive unit with a signal from said means for measuring; and means for adjusting said means for controlling to cause said drive unit to change said actual movement for causing said actual movement to correspond to a desired movement of said strand at said location.

13. The apparatus according to claim 12, wherein said means for measuring includes scan camera means.

14. The apparatus according to claim 12, further including additional means for additional measuring of a movement of said strand at an additional location between said mold and said drive unit.

15. The apparatus according to claim 14, wherein said evaluation means is for comparing said actual movement at said location with said movement at said additional location to determine vibration of said strand at said location.

16. The apparatus according to claim 15, wherein said evaluation means includes said means for adjusting to prevent production of said vibrations within at least one critical range.

* * * * *